United States Patent [19]

Fujimura

[11] Patent Number: 4,950,944

[45] Date of Patent: Aug. 21, 1990

[54] TENSED SHADOW MASK ASSEMBLY

[75] Inventor: Takeo Fujimura, Nagaokakyo, Japan

[73] Assignee: Mitsubishi Denki Kabushiki Kaisha, Kyoto, Japan

[21] Appl. No.: 241,958

[22] Filed: Sep. 8, 1988

[30] Foreign Application Priority Data

Sep. 10, 1987 [JP] Japan ..... 62-228813

[51] Int. Cl.[5] ..... H01J 29/07

[52] U.S. Cl. ..... 313/407

[58] Field of Search ..... 313/407, 408, 402

[56] References Cited

U.S. PATENT DOCUMENTS 4,280,077 7/1981 Villanyi ..... 313/408 X 4,737,681 4/1988 Dietch et al. ..... 313/402

4,745,329 5/1988 Dietch ..... 313/408 X

*Primary Examiner*—Sandra L. O'Shea

[57] ABSTRACT

A tensed shadow mask assembly for a cathode ray tube having a phosphor-deposited screen, which comprises a generally rectangular perforated plate having four corners and correspondingly four peripheral edge portions and a four-sided frame member similar in shape to the contour of the perforated plate having four fitting faces to which the respective peripheral edge portions of the perforated plate is rigidly secured while the perforated plate is held under tension. The perforated plate is generally scalloped with respect to the center thereof such that corners of the perforated plate occupy respective positions on one side away from an imaginary plane touching the center of the perforated plate and being perpendicular to the longitudinal sense of the cathode ray tube, while substantially intermediate region of peripheral edge positions between the neighboring corners occupy respective positions on the other side away from the imaginary plane.

19 Claims, 6 Drawing Sheets

TENSED SHADOW MASK ASSEMBLY

BACKGROUND OF THE INVENTION

1. Field of the Invention

The present invention generally relates to a tensed shadow mask assembly utilized in a cathode ray tube.

2. Description of the Prior Art

It is well known that a cathode ray tube utilized as a display of, for example, a television receiver set employs a shadow mask assembly which is made of a perforated thin metallic plate or foil. In the case of a color cathode ray tube, the perforated thin metallic plate or foil has a multiplicity of triads of minute circular apertures defined therein in a pattern corresponding to the triads of phosphor dots on the inner surface of the faceplate, each of the triad corresponding to the number of the primary colors.

When it comes to the manner by which the shadow mask assembly is supported inside the envelope in the vicinity of the luminescent phosphor-deposited screen, two support systems are generally utilized; one of them comprises securing the shadow mask at its peripheral edge portion to the funnel section of the cathode ray tube through a rigid frame member while the shadow mask has been formed to have a generally convex shape, and the other of them comprises securing the shadow mask, flat in shape, at its peripheral edge portion under tension to a rigid frame member which is in turn secured to the funnel section of the cathode ray tube. The shadow mask assembly utilized in connection with the generally flat phosphor-deposited screen is referred to as "flat-tensed shadow mask assembly" or, simply, "tensed shadow mask assembly".

In any event, the difference between the shadow mask support systems is discussed in U.S. Pat. No. 2,690,518, issued Sept. 28, 1954, to N. F. Fyler et al., and the details of the flat-tensed shadow mask assembly are disclosed in numerous patent publications including, for example, U.S. Pat. No. 2,755,402, issued Jul. 17, 1956, to A. Morrell.

Which one of these two systems is to be employed for the support of a particular shadow mask assembly depends on the shape of the phosphor-deposited screen of the cathode ray tube. Specifically, where the phosphor-deposited screen as a whole is generally spherical having a curvature corresponding to that of a portion of the sphere, the use of the shadow mask assembly having the generally convex shape is recommended. On the other hand, where the phosphor-deposited screen as a whole is generally flat, and particularly where the shape of the phosphor-deposited screen is such that the product of the maximum outer diameter of the phosphor-deposited screen multiplied by the average curvature of the same is of a value not greater than 0.3, the use of the flat-tensed shadow mask assembly is recommended.

In any event, the recent trend is that the flatness of the phosphor-deposited screen has come to be considered one of the factors that affect the quality of pictures displayed on the screen of the cathode ray tube. To cope with this recent trend, improvement in the flat-tensed shadow mask assembly has come to be one concern of important studies in the art.

An example of conventional flat-tensed shadow mask assemblies utilizable in association with the generally rectangular screen of the cathode ray tube is illustrated in FIG. 4. The flat-tensed shadow mask assembly generally identified by 1 comprises a generally rectangular perforated thin metallic plate 2 having a pattern of minute apertures 3 defined regularly for the passage of electron beams therethrough, and a correspondingly rectangular frame member generally identified by 10 used to support the perforated plate 2 while the latter is held under tension. The frame member 10 is made of metal so rigid as to permit the shape of the frame member 10 to withstand against the relatively high tension developed in the perforated plate 2 when the latter is secured thereto.

The frame member 10 is four-sided in shape opening at a central area thereof, and is comprised of a generally rectangular frame 11 and a flange 12 of predetermined width protruding laterally outwardly from the rectangular frame 11. The perforated plate 2 is, while having been tensed in all directions, secured at its peripheral edge portion to a flange face 13 of the flange 12 by means of a row of spot-weld desposits shown by the phantom line 20. Since the joint between the perforated plate 2 and the frame member 10 is required to have a sufficient rigidity, a reinforcement plate (not shown) similar in shape to the contour of the flange 12 may be subsequently welded to the flange 12 with the peripheral edge portion of the perforated plate 2 sandwiched therebetween. Alternatively, the reinforcement plate, the peripheral edge portion of the perforated plate 2 and the flange 12 may be welded together at the time of fitting of the perforated plate 2 to the frame member 10.

The shadow mask assembly 1 including the perforated plate 2 and the frame member 10 so connected together as hereinabove described is thereafter placed inside the funnel section of the envelope adjacent the phosphor-deposited screen of the cathode ray tube and retained in position by means of a suitable retaining mechanism (not shown) including, for example, tension springs connected to the frame member 10.

According to the prior art, the frame member 10 used to support the perforated plate 2 to complete the flat-tensed shadow mask assembly 1 has a substantial weight and is expensive to make. This is because the perforated plate 2 is highly tensed and, therefore, the frame member 10 must have a sufficient physical strength enough to withstand against any possible deformation which would occur under the influence of the tension imparted to the perforated plate 2. Of numerous deformations which the perforated plate 2 may suffer from during the use of the cathode ray tube, a warp is one of the major factors that affect the quality of picture reproduction and are therefore somewhat intensively studied.

The development of the warp in the flat-tensed rectangular shadow mask assembly will now be discussed with particular reference to FIGS. 5 to 7 in which, while the actual shape of the perforated plate 2 is shown by the single-dotted line, the perforated plate 2 is, for the sake of simplicity, shown as flat and having four right-angled corners represented by respective points A, B, C and D, with the center thereof shown by a point O. In an ideal configuration, the perforated plate 2 is completely flat with all five points A, B, C, D and O lying in the same plane, and no substantial moment tending to induce the warp occurs in the shadow mask assembly 1 including the frame member 10 even though the perforated plate 2, when held taut, may exhibit a tendency to resist the tension imparted thereto.

However, when an external force or impact is applied to the shadow mask assembly causing the perforated plate 2, then tensed in all directions, to deform in such a way as to have the points A and C displaced a distance towards points A1 and C1 in a direction perpendicular to the plane of the perforated plate 2 as shown in FIG. 6 and, consequently, the line drawn through the points A, O and C, which ought to remain straight, bends as shown by the solid line in FIG. 6. A force, acting to shorten the distance between the points A1 and C1, develops in the perforated plate 2. consequent upon this, a moment develops in the shadow mask assembly 1 itself, causing the latter to deform. This moment is substantially proportional to the force necessitated to displace the point A or C to the point A1 or C1, respectively, and, therefore, the moment increases, once the corner-to-corner bending as shown in FIG. 6 takes place, to further increase the corner-to-corner bending.

At the same time, the tension acting between the points A1 and C1 to draw these points A1 and C1 close towards each other is accompanied by the development of a pulling force by which the center point O tends to displace towards a point O1 in a direction perpendicular to the plane of the perforated plate 2. Once the center point O is consequently displaced even the slightest distance towards the point O1, another moment tending to deform the shadow mask assembly 1 as a whole develops on the line drawn through the points B, O1 and D, resulting in the displacement of the points B and D to points B1 and D1 as shown in FIG. 7. The direction in which the moment tending to bring about the corner-to-corner bending of the line drawn through the points B, O and D acts is counter to the direction in which the moment that has brought about the bending of the line drawn through the points A, O and C has acted on the perforated plate 2, and, therefore, the shadow mask assembly 1 as a whole is deformed in a manner as shown in FIG. 7.

The perforated plate 2 once so deformed will no longer deform when the force tending to deform the perforated plate 2, as discussed above, is brought in equilibrium with the drag force developed in the frame member 10 as a result of the deformation of the perforated plate 2. In any event, the deformation which may occur in the shadow mask assembly 1 is such that, since the frame member 10 is rectangular in shape and has a substantial rigidity, displacement of the portions along a pair of diagonal lines tends to be more considerable than the displacement of other portions of the perforated plate 2.

In view of the foregoing, the frame member 10 used in the conventional shadow mask assembly must be robust enough to withstand against the relatively high bending moment and must, therefore, be manufactured having a substantial weight and will be expensive, as hereinbefore discussed.

U.S. Pat. No. 3,109,117, issued Oct. 29, 1963, to S. H. Kaplan discloses, in FIG. 8 thereof, the use of a circular perforated plate scalloped with respect to the center thereof so as to have its peripheral edge undulated at three points with respect to the center thereof. However, the purpose of the use of the scalloped feature in the perforated plate disclosed in this U.S. patent is to avoid the mislanding of electron beams traveling from the three-beam electron gun assembly towards the phosphor dots on the screen. More specifically, it avoids an 'azimuth error' or a distortion of both the phosphor and the beam triads pronounced at the outer periphery of the scan raster of the cathode ray tube.

SUMMARY OF THE INVENTION

The present invention, having been devised to substantially eliminate the above discussed problems, is aimed at providing an improved tensed shadow mask assembly wherein the moment which may be developed in the perforated plate is relatively small enough so as to make it possible to utilize a light-weight frame member with the possibility of warp deformation being minimized.

In order to accomplish the above described object of the present invention, there is provided an improved tensed shadow mask assembly which comprises a generally rectangular perforated plate having four corners and correspondingly four peripheral edge portions, and a four-sided frame member similar in shape to the contour of the perforated plate having four fitting faces to which the respective peripheral edge portions of the perforated plate is rigidly secured. The perforated plate is generally scalloped or undulated with respect to the center thereof such that corners of the perforated plate occupy respective positions on one side away from an imaginary plane touching the center of the perforated plate and being perpendicular to the longitudinal sense of the cathode ray tube, while substantially intermediate region of peripheral edge portions between the neighboring corners occupy respective positions on the other side away from the imaginary plane.

Preferably, the corners of the perforated plate are set to occupy respective positions closer to the phosphor-deposited screen of the cathode ray tube than the remaining portion of the perforated plate.

According to the present invention, the perforated plate is generally scalloped with respect to the center thereof to have each side of the shape of the perforated plate undulated so that a generally intermediate point between the neighboring corners can be set back relative to any one of the corners. This unique perforated plate is secured at its peripheral edge to the correspondingly shaped frame member while held under tension. Although a moment tending to deform the frame member acts on the frame member when the perforated plate is so secured thereto, the amount of the moment is even, not unstable such as in the case of the prior art tensed shadow mask assembly, because the perforated plate is predeformed to be undulated and is not flat in shape. And the span of the frame member in which the moment acts can be advantageously reduced.

Furthermore, as described with respect to the prior art (FIG. 6), the tendency of the diagonally opposite corners to displace towards one side in a direction parallel to the longitudinal sense of the cathode ray tube away from the center of the perforated plate is accompanied by a displacement of the center in the same direction. In the present invention each corner and each intermediate region occupy respective positions on opposite sides to each other away from the center. Consequently, the displacement of the center in the same direction as the direction in which one pair of the diagonally opposite corners are displaced induces a bending moment acting to displace the intermediate regions in the opposite direction, which in turn induces a moment acting to displace the other pair of the diagonally opposite corners to displace in the same direction with the one pair of the diagonally opposite corners. Therefore, the phenomenon in which the shape of the perforated plate tends to become insecure as a result of the displacement of two pairs of the diagonally opposite corners taking in respective directions opposite to each other, such as occurring in the prior art flat-tensed shadow mask assembly, can be substantially eliminated.

With the above described advantages, the unique perforated plate of the present invention cooperates with the frame member to minimize the possible deformation of the tensed shadow mask assembly. In particular, any possible deformation of the tensed shadow mask assembly being manufactured, which is hitherto noticeable during the manufacture of the shadow mask type cathode ray tube, could be advantageously minimized or substantially eliminated.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

DETAILED DESCRIPTION OF THE EMBODIMENTS

Figure 1:
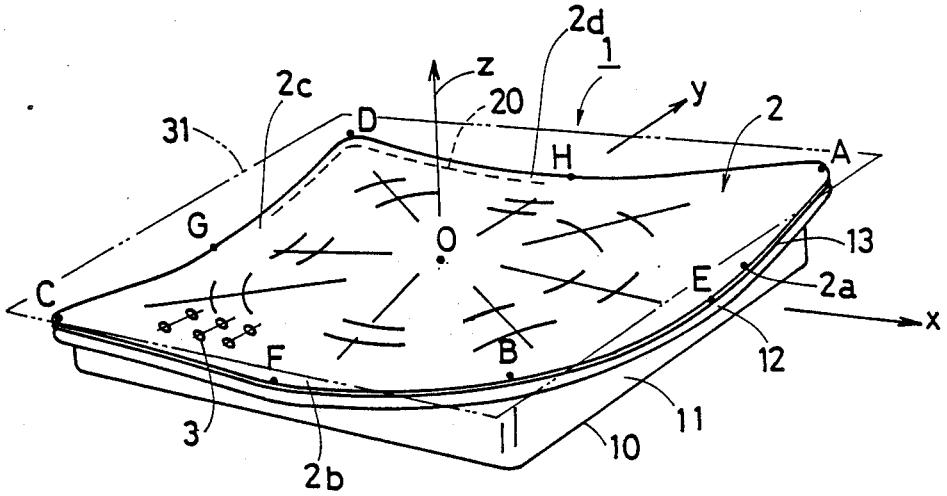
FIG. 1 is a schematic perspective view of a tensed shadow mask assembly herein provided in accordance with one preferred embodiment of the present invention.

Referring first to FIG. 1, there is shown a generally rectangular perforated, thin metal plate 2 having a predetermined pattern of apertures 3 (only portion thereof being shown) defined therein. The perforated plate 2 has four corners, shown by respective points A, B, C and D, and correspondingly four peripheral edge portions 2*a*, 2*b*, 2*c* and 2*d*, the peripheral edge portions 2*a* and 2*c* having a length smaller than that of the peripheral edge portions 2*b* and 2*d*. This perforated plate 2 is secured at these peripheral edge portions 2*a* to 2*d* to the frame member 10 by means of a row of spot-weld deposits shown by the phantom line 20 while held under tension in all directions. The perforated plate 2 is generally scalloped or undulated with respect to the center O thereof such that an intermediate region, shown by a respective point E, F, G or H, of each peripheral edge portion 2*a*, 2*b*, 2*c* and 2*d* of the perforated plate 2 is set back relative to the neighboring corners A and B, B and C, C and D or D and A that are continued with each other through such intermediate region E, F, G or H of the respective peripheral edge portion 2*a*, 2*b*, 2*c* or 2*d* in a direction generally perpendicular to the perforated plate and generally parallel to the longitudinal sense of the cathode ray tube.

The details of the shape of the perforated plate 2 according to the present invention will now be discussed with particular reference ot FIGS. 1 and 2. For the purpose of this discussion, the Cartesian coordinate system is depicted on the perforated plate 2 with the origin lying in alignment with the center O and with the X-axis and Y-axis lying respectively parallel to the line through the intermediate regions E and G of the associated peripheral edge portions 2*a* and 2*c* and parallel to the line through the intermediate regions F and H of the associated peripheral edge portions 2*b* and 2*d* as clearly shown in FIG. 1. The longitudinal axis of the cathode ray tube passing through the center O of the perforated plate 2 is shown as a Z-axis. In addition, areas of the perforated plate 2 delineated by the points A, E, O and H, the points B, F, O and E, the points C, F, O and G and the points D, G, O and H, respectively, are hereinafter referred to as the first, second, third and fourth segments, respectively.

With the perforated plate 2 so scalloped as hereinbefore described, the first to fourth segments of the perforated plate 2 are of the same shape, that is, the first and second segments are symmetrical with the fourth and third segments respectively with respect to the Y-axis and the first and fourth segments are symmetrical with the second and third segments respectively with respect to the X-axis. At the same time, considering the imaginary flat plane 2A shown in FIG. 2 perpendicular to the longitudinal sense of the cathode ray tube or Z-axis and touching the center O of the perforated plate 2 which is depressed in a direction away from the phosphor-deposited screen of the cathode ray tube shown by the double dotted chain line 31 in FIG. 1. The corners A, B, C and D occupy respective positions closer to the phosphor-deposited screen 31 than to the imaginary plane 2A and the intermediate regions E, F, G and H occupy respective positions farther from the phosphor-deposited screen 31. FIG. 2(*a*) illustrates, in the form of a line drawing, the cross-sectional shape of the perforated plate 2 taken along the diagonal direction extending between the corners A and C, with the phosphor-deposited screen 31 assumed to be flat; FIG. 2(*b*) similarly illustrates the cross-sectional shape of the same perforated plate 2 taken along the X-axis; and FIG. 2(*c*) similarly illustrates the cross-sectional shape of the same perforated plate 2 taken along the Y-axis.

While the perforated plate 2 is so constructed as hereinbefore described, the four fitting faces of the flanges 12 of the respective frames 11 forming the four-sided frame member 10 similar in shape to the contour of the perforated plate 2 are so shaped and so undulated to follow the contours of the respective peripheral edge portions 2*a* to 2*d* of the perforated plate 2 so that, when the scalloped perforated plate 2 is secured to the frame member 10, the respective peripheral edge portions 2*a* to 2*d* can be held in tight contact with the associated fitting faces of the frame flanges 12.

In the construction according to the present invention as hereinbefore described, it may happen that a bending moment may be induced to bring the diagonally opposite corners A and C close towards the phosphor-deposited screen 31 by the action of the tension acting in the diagonal direction along the line drawn through the points A, O and C. However, the amount of the bending moment is, unlike that in the prior art flat-tensed shadow mask, relatively stabilized and can be easily brought at a predetermined position into equilibrium with the drag force counteracting the bending of the frame member 10 because the perforated plate 2 is pre-deformed to be undulated and not flat in shape. In other words, according to the present invention, the possibility such as observed in the prior art flat-tensed shadow mask assembly can be minimized so that, while the bending moment is zero under the ideal condition, even the slightest deformation may result in the abrupt increase of the bending moment by the effect of the tension and the point at which the increased bending moment may be brought into equilibrium with the drag force induced in the frame member cannont be easily predicated.

Figure 7:
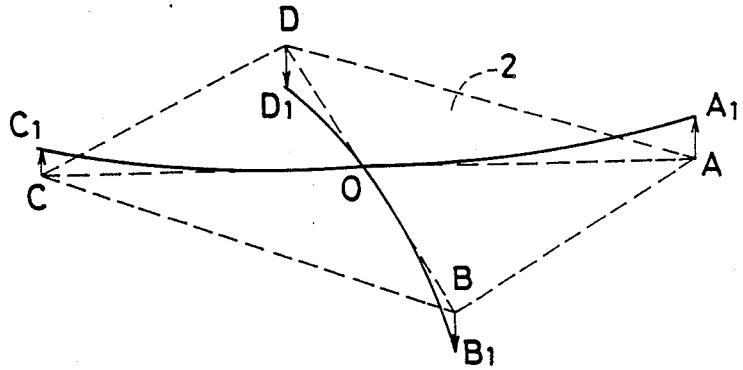
Fig.7 Prior Art

It has been described in connection with the prior art flat-tensed shadow mask assembly that the deformation of the perforated plate 2 by the action of the bending moment with the diagonally opposite corners A and C tending to displace towards the respective points A1 and C1 is necessarily accompanied by the development of the bending moment acting to displace the diagonally opposite corners B and D towards the respective points B1 and D1 as shown in FIG. 7 in a direction counter to the direction in which the corners A and C are displaced. This phenomenon does not substantially occur in the tensed shadow mask assembly according to the present invention by the reason which will now be described.

Figure 2A:
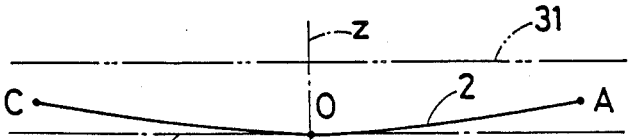
FIG. 2 is a line drawing showing a different shape of the cross-section of a thin perforated plate used in the shadow mask assembly of FIG. 1, wherein FIG. 2(*a*) represents the cross-section of the perforated plate taken along the diagonal direction thereof, FIG. 2(*b*) represents the cross-section of the same perforated plate taken along an X-axis direction with the center of said perforated plate taken as the origin of the Cartesian coordinate system and FIG. 2(*c*) represents the cross-seciton of the same perforated plate taken along a Y-axis direction perpendicular to the X-axis direction.
Figure 2B:
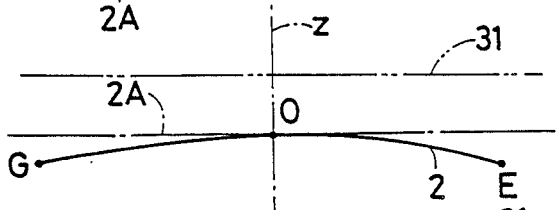
Figure 2C:
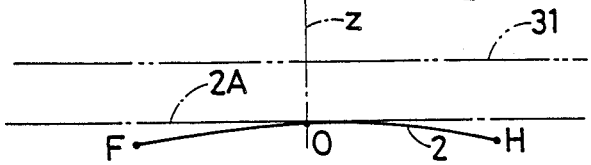
Figure 6:
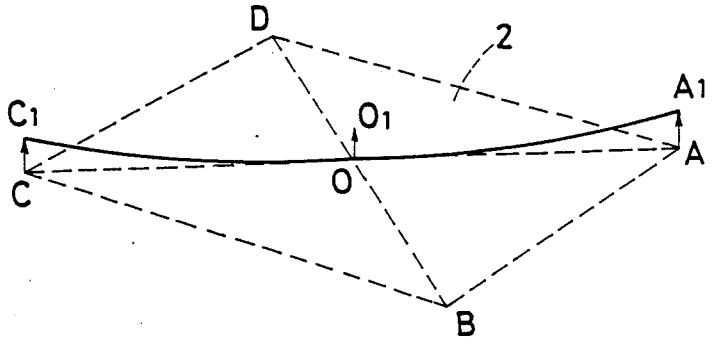
Fig.6 Prior Art

As can be understood from FIGS. 1 and 2, the tendency of the diagonally opposite corners A and C to displace upwardly as viewed in FIG. 2 is accompanied by upward displacement of the center O as described with reference to FIG. 6, and consequently induces a bending moment acting to displace the intermediate regions E and G and the intermediate regions F and H downwardly as viewed in FIG. 2. This, in turn, possibly induces a moment acting to displace the diagonally opposite corners B and D to displace in the same direction as the direction in which the diagonally opposite corners A and C are displaced. Therefore, the phenomenon, in which the shape of the perforated plate 2 tends to become insecure as a result of the displacement of the diagonally opposite corners A and C and that of the diagonally opposite corners B and D taking in respective directions opposite to each other such as occurring in the prior art flat-tensed shadow mask assembly, can be substantially eliminated.

Instead, in the tensed shadow mask assembly according to the present invention, a problem may possibly occur when any moment is induced causing any one of the corners A, B, C and D of the perforated plate 2 and any one of the intermediate regions E, F, G and H to displace in respective directions counter to each other. In other words, while in the prior art shadow mask assembly the bending moment induced in each neighboring sides (neighboring peripheral edge portions) of the perforated plate 2 was a problem, the bending moment induced in each side (peripheral edge portion) of the perforated plate 2 in the illustrated embodiment may pose a problem.

However, in the illustrated embodiment of the present invention, the peripheral edge portion which sustains the bending moment is, for example, the portion between the corners A and B, and the length of the portion is smaller than that in the perforated plate used in the prior art shadow mask assembly. This is because, as hereinbefore described, the respective peripheral edge portion which sustains the bending moment is, for example, the portion between A and C via B. Therefore, the frame member 10 utilizable in the practice of the present invention can have a relatively low bending rigidity and can be advantageously manufactured having a light-weight feature.

Hereinafter, the reason for the employment of the scalloped feature in the perforated plate 2 according to the present invention will be described.

Figure 8:
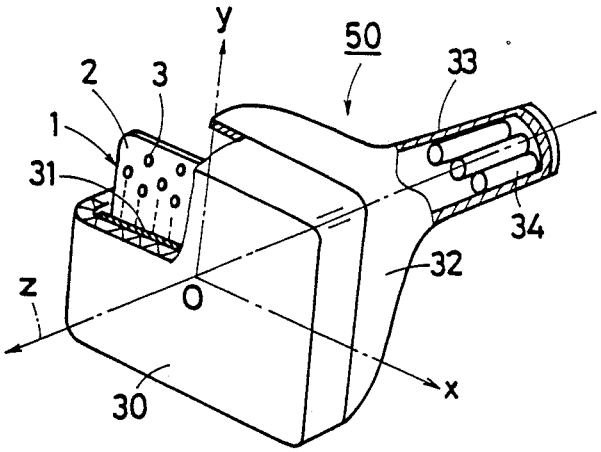
FIG. 8 is a schematic perspective view, with portions cut away, of a shadow mask type color cathode ray tube.

To begin with, how the spacing between the perforated plate 2 and the phosphor-deposited screen 31 is determined will first be described. As shown in FIG. 8, the color cathode ray tube, generally identified by 50, comprises a faceplate 30 having an inner surface deposited with phosphor dots to form the phosphor-deposited screen 31, and a funnel section 32 of generally frusto-conical shape having a large-sized end continued or welded to the periphery of the faceplate 30 with the phosphor-deposited screen 31 situated inside. It further comprises a generally cylindrical neck section 33 continued at one end to a reduced-size end of the generally frusto-conical funnel section 32 and closed at the opposite end. Further, an in-line electron gun assesmbly 34 is included which is comprised of three electron guns shown by 34B, 34G and 34R in FIG. 10 arranged in line with each other and housed within the neck section 33. The shadow mask assembly 1 has the perforated metal 2 disposed in the close vicinity of the phosphor-deposited screen 31. It is to be noted that, in FIG. 8, the frame member 10 is not illustrated, for the sake of brevity.

Figure 9:
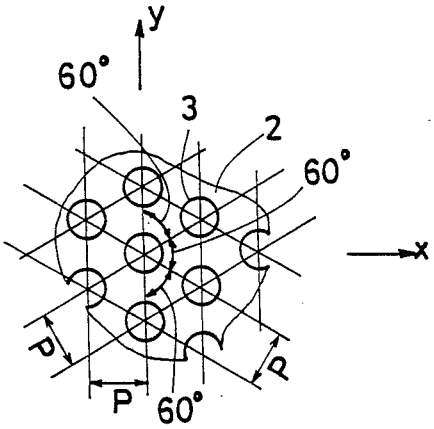
FIG. 9 is an elevational view, on an enlarged scale, of a portion of the perforated plate, showing a pattern of apertures defined in the perforated plate.

As a matter of fact, the perforated plate 2 has a regularly defined pattern of minute circular apertures 3. The pattern of the minute circular apertures 3 is so selected so as to occupy respective points of intersections of first, second and third sets of imaginary parallel lines spaced an equal distance P. The first set of the imaginary parallel lines is drawn so as to extend parallel to the Y-axis direction while the imaginary parallel lines of the first to third sets intersect at an angle of 60° relative to the next adjacent imaginary lines as shown in FIG. 9.

Figure 10:
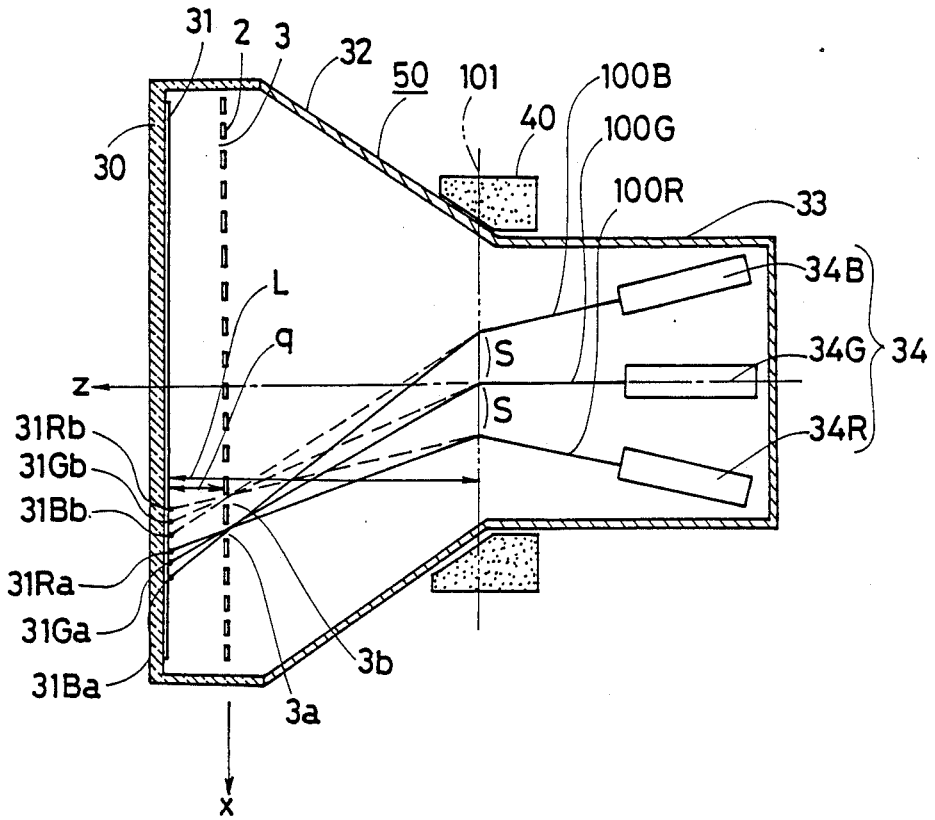
FIG. 10 is a schematic longitudinal sectional view of the shadow mask type color cathode ray tube.

Referring now to FIG. 10, there is schematically shown the color cathode ray tube 50 as sectioned along a plane containing the X-axis and Z-axis. As shown therein, the three electron guns 34B, 34G and 34R forming the electron gun assembly 34 are arranged in line with each other in a direction parallel to the X-axis direction.

When the color cathode ray tube 50 of the above principle construction is operated, electron beams 100B, 100G and 100R emanate from the respective electron guns 34B, 34G and 34R and travel straight towards the phosphor-deposited screen 31. However, as the electron beams 100B, 100G and 100R traveling towards the phosphor-deposited screen 31 pass through an imaginary deflection plane 101, defined by a deflection yoke assembly 40 mounted exteriorly on the envelope at the portion adjacent the joint between the funnel section 32 and the neck section 33. The electron beams 100B, 100G and 100R are deflected under the influence of the magnetic field developed by the deflection yoke assembly 40 at acute angles relative to the longitudinal sense of the cathode ray tube. Thereafter, they again assume straight paths towards the phosphor-deposited screen 31.

Let it be assumed that at the imaginary deflection plane 101 the electron beams 100B, 100G and 100R are spaced a distance indicated by S from the neighboring electron beams.

The three electron beams 100B, 100G and 100R having been deflected at the imaginary delfection plane 101 subsequently pass through one of the apertures 3 in the perforated plate 2, for example, the single aperture shown by 3*a* in FIG. 10. They then impinge upon the phosphor-deposited screen 31 at respective points 31Ba, 31Ga and 31Ra of impingement. In parctice, the electron beams 100B, 100G and 100R so deflected swing or scan generally horizontally across the scan raster of the cathode ray tube. Therefore, the next succeeding horizontal scanning current is supplied to the deflection yoke assembly 40, the three electron beams deflected at different angles than the angles of deflection of the above decribed electron beams tranvel as shown by the dotted lines. They then enter next adjacent aperture 3*b* in the perforated plate 2 and subsequently impinge upon the phosphor-deposited screen 31 at respective impingement points 31Bb, 31Gb and 31Rb.

Assuming that the distance, between the phosphor-deposited screen 31 and that portion of the perforated plate 2 where the apertures 3*a* and 3*b* now under discussion, are defined, is expressed by q, it is theoretically considered ideal that, in order to maximize the tolerance of the purity of colors reproduced by the color cathode ray tube, the distance q should be so selected as to permit the triad of the impingement points 31Ba, 31Ga, 31Ra or 31Ba, 31Gb, 31Rb to be spaced an equal distance from each other. This can be expressed by the following equation:

$$q = (P \cdot L)/(S \cdot \sqrt{3}) \quad (1)$$

wherein L represents the distance between the phosphor-deposited screen 31 and the imaginary delfection plane 101 and can be substantially taken as a constant.

While reference has been made to the deflection of the electron beams 100B, 100G and 100R in the direction parallel to the X-axis direction, the foregoing description including the equation (1) can be equally applicable even where the electron beams are deflected in the direction parallel to the Y-axis direction or simultaneously in both directions parallel to the X-axis and Y-axis directions. In any event, the distance q is proportional to the distance P and in inverse proportion to the distance S.

Also, in the foregoing description the electron beams 100B, 100G and 100R emanating from the respective electron guns 34B, 34G and 34R have been described and shown as traveling straight towards the imaginary deflection plane 101. In practice, however, it is a necessary practice that in the color cathode ray tube convergence is effected so as to permit the electron beams to be deflected so that they can intersect at a position of the phosphor-deposited screen 31 or the perforated plate 2.

For this purpose, various designs have been made to employ a particular pattern of distribution of magnetic field developed by the deflection yoke assembly 40 on one side of the cathode ray tube adjacent the electron gun assembly 34 (or, an auxiliary deflection device may be provided exteriorly on the neck section 33 at a location between the deflection yoke assembly 40 and the electron gun assembly 34 as the case may so require) so that, when the electron beams 100B, 100G and 100R are deflected to reach a peripheral region ($x \neq 0$ and/or $y \neq 0$) of the screen of the cathode ray tube, these electron beams can be deflected so as to slightly increase the interval of the triads of these electron beams before they reach the imaginary deflection plane 101. In other words, the distance S is generally a function of the position (x, y) on the phosphor-deposited screen 31 upon which the electron beams impinge. It can be expressed by the following formula:

$$S = SO + S1 \cdot (x, y) \quad (2)$$

wherein SO represents the value of the distance S given when the electron beams without being deflected impinge upon the center (0, 0) of the phosphor-deposited screen 31 and S1 is generally a function of x and y and increases with increase of any one of the absolute values of x and y. Applying the above discussion to the parameter q used in the previously discussed equation (1), it will readily be understood that, if the pitch P is constant, the parameter q is maximum at the center of the phosphor-deposited screen 31 and decreases with increase of any one of the absolute values of x and y and ought to be minimum at a diagonal corner of the phosphor-deposited screen 31.

In the prior art flat-tensed shadow mask assembly, in order to satisfy the conditions expressed by the equations (1) and (2), it has been a general practice either to cause the phosphor-deposited screen 31 and, hence, the inner surface of the faceplate 30 to represent a generally concave shape with respect to the direction of travel of the electron beams from the electron gun assembly 34, not a flat shape, or to permit the pitch P to be slightly varied on the perforated plate 2. The former mentioned approach tends to pose a problem in that, since the phosphor-deposited screen 31 which ought to be completely flat represents a curved shape, pictures reproduced on the screen of the cathode ray tube tends to be uncomfortable to look at. Also, the latter approach tends to pose a problem in that, although a satisfactory result can be obtained at positions adjacent any one of the x-axis and Y-axis, the condition at which a group of straight lines passing through the center of the aperture 3 forms a predetermined angle tends to be impaired considerably at any one of the diagonal corners of the phosphor-deposited screen 31 by the cumulative effect of change in pitch P. Therefore, the tolerance of the landing of the electron beams tends to be reduced.

Furthermore, although no reason is herein given, there is an additional problem in that the line of contour of the outermost periphery of the phosphor-deposited screen 31 tends to become uncomfortable to look at.

In the embodiment described with reference to and shown in FIG. 1, however, the intermediate regions or the respective peripheral portions 2*b* and 2*d* of the perforated plate 2 lying on the x-axis and the intermediate regions of the respective peripheral portions 2*a* and 2*c* of the same perforated plate 2 lying on the Y-axis are spaced away from the phosphor-deposited screen 31 as compared with the distance between the center O of the same perforated plate 2 and the phosphor-deposited screen 31. Therefore, although, if the phosphor-deposited screen 31 is flat, the pitch P at any one of the intermediate regions of the respective peripheral portions 2*a* to 2*d* lying on the x-axis and Y-axis must be sufficiently small as compared with that employed in the prior art shadow mask assembly, the distance q at the diagonal corners which often poses a problem can be reduced. Therefore the complicated problem brought about by the cumulative effect of change in pitch P at the diagonal corners can be considerably lessened if distance between any one of the points A to H and the phosphor-deposited screen 31 and the shape of the curve depicted by the imaginary line in FIG. 1 connecting the points A to H together are selected properly. The foregoing is a reason for the selection of the shape of each peripheral edge portion of the perforated plate 2 according to the present invention wherein the diagonal corners A, B, C and D are closer to the phosphor-deposited screen 31 than the intermediate regions of the respective peripheral portions of the same perforated plate 2 such as described in connection with the illustrated embodiment.

Figure 11:
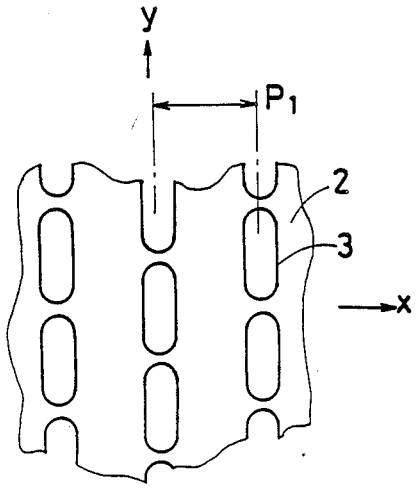
FIG. 11 is a view similar to FIG. 9, showing a different pattern, of apertures defined in the perforated plate.

In the foregoing embodiment of the present invention, the shape of each aperture 3 in the perforated plate 2 has been described and shown as circular. However, as shown in FIG. 11, the apertures 3 in the perforated plate 2 may be in the form of slots extending in parallel rows spaced a pitch P1 in a direction perpendicular to the longitudinal sense of each aperture 3.

Where the apertures 3 in the perforated plate 2 are in the form of the slots as shown in FIG. 11, the equation (1) which is descriptive of the distance q between the phosphor-deposited screen 31 and the perforated plate 2 may supersede the following equation:

$$q=(P1\cdot L)/3S \qquad (3).$$

An additional feature which cannot be found in the prior art flat-tensed shadow mask assembly, but can be found in the tensed shadow mask assembly according to the present invention, will now be discussed.

As hereinbefore described, the shadow mask assembly is secured to the frame member 10 while tensed in all directions, that is, in respective directions parallel to the x-axis and Y-axis. If the perforated plate is completely flat and, hence, elongation thereof under tension is uniform, even the slightest unevenness of the tension and/or the deformation of the frame member 10 after the perforated plate has been secured thereto would result in formation of wrinkles on the perforated plate 2. The formation or presence of such wrinkles on the perforated plate 2 is descriptive of the lack of tension in a direction generally perpendicular to the direction in which the wrinkles extend. Also, in most cases, the tension of the perforated plate 2 in the direction generally perpendicular to the direction of extension of the wrinkles is presumed to be zero. As a matter of fact, the wrinkles on the perforated plate 2 necessarily permit those portions of the perforated plate 2 where the wrinkles are formed to vibrate considerably when mechanical shocks act on the perforated plate 2 during the operation of the color cathode ray tube, thereby constituting a cause of picture reproduction uncomfortable to look at.

Such wrinkles are often caused when the tensioning of the perforated plate with the use of jigs is insufficient enough to create an uneven tension, or when localized elongation occurs in the perforated plate during a heat treatment such as, for example, annealing, or in the presence of one or more bends in the perforated plate. In order to avoid the formation of the wrinkles, means must be taken to permit the perforated plate to be uniformly tensed in insufficient strength in all directions. However, the tension necessarily acts on the entire surface area of the perforated plate and, accordingly, the frame member 10 tends to be excessively loaded to such an extent as may result in the increased tendency of the frame member 10 to be deformed.

Once the wrinkles are formed on the perforated plate, glittering such as color displacement can be observed in the pictures being reproduced on the screen of the color cathode ray tube as a result of vibrations of the perforated plate. A cause of this is that the perforated plate 2 undergoes localized vibrations in a direction parallel to the longitudinal sense of the color cathode ray tube, that is, in the direction parallel to the z-axis. The adverse influence brought about by the localized vibration of the perforated plate 2 in the direction parallel to the longitudinal sense of the cathode ray tube is minimum (the quantity observed as the color displacement for a given displacement of the perforated plate is minimum) at the center of the phosphor-deposited screen 31. However, it increases in proportion to the sine of the angle of deflection at a peripheral portion of the phosphor-deposited screen 31, that is, where the electron beams largely deflected impinge. Therefore, the presence of the wrinkles brings about relatively small damage at a central region of the phosphor-deposited screen 31, but relatively large damage as the distance goes away from the central region of the phosphor-deposited screen 31 towards the peripheral region thereof.

However, according to the illustrated embodiment of the present invention, although as clearly shown in FIG. 1 the perforated plate 2 is substantially completely flat at the central region thereof, the fitting faces 13 of the flanges 12 of the frame member 10 are undulated. Therefore, the peripheral portions 2*a* to 2*d* of the perforated plate 2, when secured to the corresponding fitting faces 13 of the flanges 12 of the frame member 10 and then held under tension, are necessarily undulated to cope with the respective shapes of the fitting faces 13. Therefore, as described with reference to FIG. 6, the perforated plate 2 can be supported by the frame member 10 while the tension acting on each peripheral edge portion 2*a* to 2*d* of the perforated plate 2 in a direction parallel to the direction in which each associated frame of the frame member 10 extends is higher than that on the central region of the perforated plate 2. Although an increase of the tension acting in the direction parallel to the direction in which each frame of the frame member 10 extends may be somewhat accompanied by an increase of the tension acting in a direction perpendicular to the direction of extension of each frame of the frame member 10, that is, in a direction radially outwardly from the center O (the amount of increase depends on the Poisson's ratio), the average tension at the peripheral portions 2*a* to 2*d* of the perforated plate 2 can be advantageously increased without the possibility that the tension acting in the direction radially outwardly from the center O, that is, in a direction acting between the points A and C and the points B and D may be increased. In other words, the formation of the unwanted wrinkles at the peripheral portions of the perforated plate 2 can be minimized without the frame members 10 excessively burdened.

Although the present invention has fully been described in connection with the preferred embodiment thereof with reference to the accompanying drawings used only for the purpose of illustration, those skilled in the art will readily conceive numerous changes and modifications within the framework of obviousness upon the reading of the specification herein presented of the present invention. By way of example, although in the foregoing description no relationship between the amount of tension applied in the x-axis direction and that in the Y-axis direction has been specified. However, in the case of the shadow mask assembly in which the perforated plate 2 has the slots 3 defined therein as shown in FIG. 11, it may be contemplated to vary the average value of the tension acting in a direction parallel to the direction of extension of each row of the slots 3 and that in the direction perpendicular to the direction of extension of each row of the slots 3.

Figure 3:
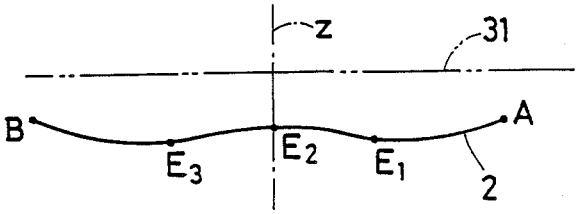
FIG. 3 illustrates another preferred embodiment of the present invention and is a line drawing showing the cross-section of one side of the perforated plate parallel to the X-axis direction.
Figure 4:
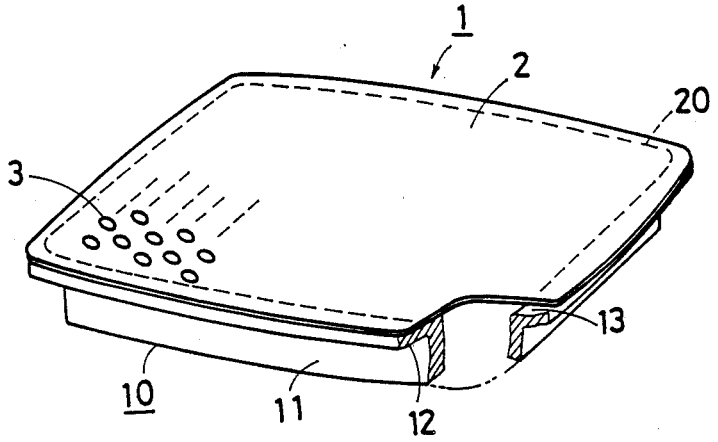
Fig. 4 Prior Art
FIG. 4 is a schematic perspective view, with a portion cut away, of the prior art flat-tensed shadow mask assembly.
Figure 5:
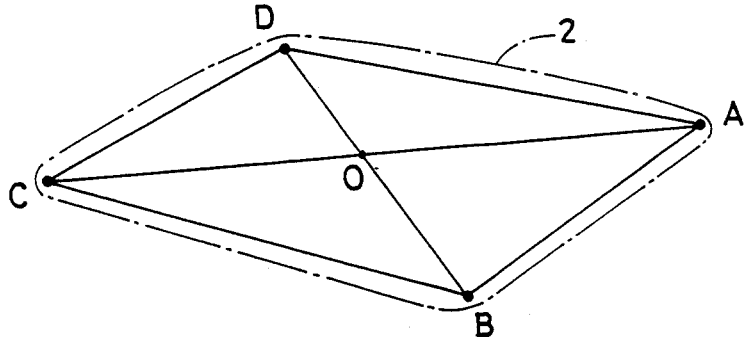
Fig. 5 Prior Art
FIGS. 5 to 7 are schematic diagrams showing the perforated metal used in the prior art flat-tensed shadow mask assembly, illustrating the sequence in which the perforated metal is deformed.

Also, the distance from a plate, delimited by the diagonally opposite corners A, B, C and D to any one of the intermediate points E and G of the respective peripheral portions 2*a* and 2*c* of the perforated plate 2, may be different from the distance from such plane to any one of the intermediate points F and H of the respective peripheral portions 2*b* and 2*d* of the perforated plate 2. Moreover, although in the foregoing embodiment reference has been made to the single undulated point lying on any one of the intermediate regions E, F, G and H of the respective peripheral portions 2*a*, 2*b*, 2*c* and 2*d* of the perforated plate 2, two or more undulated points may be employed in each of the peripheral portions 2*a* to 2*d* of the perforated plate 2 such as shown in FIG. 3 which illustrates the peripheral edge portion 2*a* undulated at E1, E2 and E3 by way of example.

From the foregoing full description of the present invention, since the perforated plate is generally scalloped or undulated with respect to the center thereof such that a substantially intermediate region of each peripheral edge portion of the perforated plate is set back relative to the neighboring corners that are continued with each other through such intermediate region of the respective peripheral edge portion in a direction generally perpendicular to the perforated plate and generally parallel to the longitudinal sense of the cathode ray tube, the adverse influence which the tensed perforated plate may bring about on the frame member can be advantageously minimized or can be brought to a constant value, thereby to permit the frame member to be stabilized. Therefore, the frame member which can be utilized in the practice of the present invention may have a reduced physical strength with the possible deformation minimized and may, therefore, be inexpensive to make.

Also, while according to the prior art flat-tensed shadow mask assembly the cumulative effect of variation of the pitch between the neighboring apertures in the perforated plate has often brought about the reduction in design tolerance and the phenomenon in which the arrangement of the apertures defining the contour line of the phosphor-deposited screen of the cathode ray tube at the perimeter of the effective raster screen tends to be uncomfortable to look at, the present invention is effective not only to minimize such phenomenon, but also to lessen the phenomenon in which the undesirable glittering of the reproduced picture, accompanied by the color displacement, which has hitherto resulted from the vibration of the perforated plate by the effect of external mechanical shocks.

Although in the foregoing embodiment the corners A, B, C and D have been described as located closer to the phosphor-deposited screen 31 than the intermediate regions E, F, G and H of the respective peripheral portions 2*a* to 2*d* of the same perforated plate 2, the concept of the present invention can be equally applicable where the intermediate regions E to H of the respective peripheral portions 2*a* to 2*d* are located closer to the phosphor-deposited screen 31 than the corners A to D of the perforated plate 2.

The shape of the frame member 10, and particularly the cross-sectional shape of the frame member 10, may not be always limited to that shown and described and the frame member 10 may have any suitable cross-sectional shape provided that the fitting faces 13 are undulated as hereinbefore described.

The present invention can be also applicable to the shadow mask assembly of a type which is integrated with the faceplate 30 partly because the physical strength of the frame member 10 has a close relationship with the faceplate 30 and, when the shadow mask assembly 1 is removed from the faceplate 30, the shadow mask assembly 1 can no longer retain the shape by itself. Therefore, no predetermined tension is applied to the perforated plate 2 and bacause the frame member 10 can retain the predetermined shape when fitted to and then reinforced substantially by the faceplate 30. In such application, the shape of the perforated plate 2 and the manner by which the perforated plate 2 is held under tension should be discussed under a condition in which the shadow mask assembly 1 has been fitted to the faceplate 30.

Accordingly, such changes and modifications are, unless they depart from the spirit and scope of the present invention as delivered from the claims annexed hereto, to be construed as included therein.

What is claimed is:

1. A tensed shadow mask assembly for use in a cathode ray tube, which comprises:

a generally rectangular perforated plate having four corners and correspondingly four peripheral edge portions; and a four-sided frame member similar in shape to the contour of the perforated plate having four fitting faces to which the respective peripheral edge portions of the perforated plate are rigidly secured while said perforated plate is held under tension;

said perforated plate being generally scalloped with respect to the center thereof such that occurs of the perforated plate occupy respective positions facing in one direction away from an imaginary plane touching the center of the perforated plate and being perpendicular to the longitudinal sense of the cathode ray tube, while a midpoint of each said peripheral edge portion between the neighboring corners occupy respective positions in an opposite direction faceing away from the imaginary plane.

2. The tensed shadow mask assembly as claimed in claim 1, wherein, when the shadow mask assembly is mounted inside the cathode ray tube, the corners of the perforated plate occupy respective positions which are closer than other portions of the perforated plate to a phosphor-deposited screen of the cathode ray.

3. The tensed shadow mask assembly as claimed in claim 1, wherein said frame member is of a generally rectangular shape and comprises four frame edges and correspondingly four flanges integrated with said respective frames so as to represent a generally L-shaped cross-section, each of said fitting faces being defined in each respective flange, each said flange having a greater thickness at a position corresponding to the respective corners of the perforated plate than at a position corresponding to the midpoint region of each respective peripheral edge portions of the perforated plate so as to make said fitting faces undulated when receiving the peripheral edge portions of the perforated plate.

4. The tensed shadow mask assembly as claimed in claim 3, wherein each of said flanges has a thickness which is progressively varying over the length thereof and which is a maximum at the position corresponding to the respective corner of the perforated plate and a minimum at a position corresponding to the midpoint region of each respective peripheral edge portion of the perforated plate.

5. A cathode ray tube which comprises, in combination:

an envelope including a faceplate, a funnel section and a neck section with said funnel section positioned intermediate between the faceplate and the neck section;

a phosphor-deposited screen formed on an inner surface of the faceplate;

an in-line electron gun assembly including three electron guns arranged inside the neck section in line with each other in a direction perpendicular to the longitudinal sense of the cathode ray tube; and a tensed shadow mask assembly disposed within the envelope proximate to the phosphor-deposited screen, said shadow mask assembly including, a generally rectangular perforated plate having four corners and corresponding four peripheral edge portions and a four-sided frame member similar in shape to the contour of the perforated plate having four fitting faces to which the respective peripheral edge portions of the perforated plate are rigidly secured while the perforated plate is under tension, said perforated plate being generally scalloped with respect to the center thereof such that corners of the perforated plate occupy respective positions facing in one direction away from an imaginary plane touching the center of the perforated plate and being perpendicular to the longitudinal sense of the cathode ray tube, while a midpoint region of each said peripheral edge portion between the neighboring corners occupy respective positions in an opposite direction facing away from the imaginary line.

6. The cathode ray tube as claimed in claim 5, wherein four corresponding flanges are integrated within said respective four-sided frame member, each of said flanges having a thickness which is progressively varying over the length thereof and which is a maximum at a position corresponding to each respective corner of the perforated plate and a minimum at a position corresponding to the midpoint region of each respective peripheral edge portion of the perforated plate.

7. A tensed shadow mask assembly for use in a cathode ray tube, comprising:

a perforated plate, with a generally rectangular contour, having four corners and four corresponding edge portions;

four-sided framing means, similar in shape to the contour of said perforated plate, for holding said perforated plate under tension by rigidly securing said four edge portions of said perforated plate to four corresponding fitting faces of said four-sided framing means;

said perforated plate being generally scalloped with respect to the center thereof, such that portions of said perforated plate extending from the center thereof to each of the four corners is beveled in an upward sloping manner and portions of said perforated plate extending from the center thereof to a midpoint of each of said four edge portions is beveled in a downward sloping manner.

8. A tensed shadow mask assembly, as claimed in claim 7, wherein the distance from the center of said perforated plate to each of said midpoints of the four edge portions is equal; and wherein the distance from the center of said perforated plate to each of said four corners is equal.

9. A tensed shadow mask assembly, as claimed in claim 7, wherein said perforated plate contains a plurality of apertures arranged in sequential, parallel columns.

10. A tensed shadow mask assembly, as claimed in claim 9, wherein said apertures are circular in shape.

11. A tensed shadow mask assembly, as claimed in claim 10, wherein each column of circular apertures contain a plurality of circular apertures arranged at a two (2) aperture pitch; and wherein successive columns of circular apertures are arranged in alternating one (1)-aperture pitches such that each circular aperture is located at two (2) aperture pitch from all immediately surrounding apertures within a 360° radius at every 60 degree angle.

12. A tensed shadow mask assembly, as claimed in claim 9, wherein said apertures are elliptical in shape.

13. A cathode ray tube (CRT) comprising:

a housing including a faceplate, a funnel section and a neck section, said funnel section positioned between said faceplate and said neck section;

a phosphor-deposited screen formed on an inner surface of said faceplate;

an electron gun assembly including three electron guns arranged inside said neck section in a direction perpendicular to the longitudinal sense of said cathode ray tube; and a tensed shadow mask assembly, disposed within said housing proximate to said phosphor deposited screen, said shadow mask assembly including, a perforated plate, with a generally rectangular contour, having four corners and four corresponding edge portions, four-sided framing means, similar in shape to the contour of said perforated plate, for holding said perforated plate under tension by rigidly securing said four edge portions of said perforated plate to four corresponding fitting faces of said four-sided framing means, said perforated plate being generally scalloped with respect to the center thereof, such that portions of said perforated plate extending from the center thereof to each of the four corners is beveled in an upward sloping manner, and portions of said perforated plate extending from the center thereof to a midpoint of each of said four edge portions is beveled in a downward sloping manner.

14. A cathode ray tube, as claimed in claim 13, further comprising:

a defection yoke beam assembly means, located at the intersection between said funnel section and said neck section, for deflecting beams emitted by said three electron guns of said electron gun assembly during operation of said CRT, by creating a magnetic field which deflects said beams at an acute angle.

15. A CRT, as claimed in claim 13, wherein said perforated plate contains a plurality of apertures arranged in sequential, parallel columns.

16. A CRT, as claimed in claim 15, wherein said apertures are circular in shape.

17. A CRT, as claimed in claim 16, wherein each column of circular apertures contains a plurality of circular apertures arranged at two(2) aperture pitch; and wherein successive columns of circular apertures are arranged in alternating one (1)-aperture pitches such that each circular aperture is located at two (2) aperture pitch from all immediately surrounding apertures within a 360° radius at every 60 degree angle.

18. A CRT, as claimed in claim 15, wherein said apertures are elliptical in shape.

19. A CRT, as claimed in claim 13, wherein the distance from the center of said perforated plate to each of said midpoints of the four edge portions is equal; and wherein the distance from the center of said perforated plate to each of said four corners is equal.

* * * * *